United States Patent [19]

Reynolds et al.

[11] 4,148,445

[45] Apr. 10, 1979

[54] APPARATUS AND METHOD FOR DISPENSING AND RETRIEVING FLEXIBLE PIPE

[75] Inventors: John L. Reynolds; Jack L. Sappington, both of Midland; Lawrence J. Sullivan, Odessa, all of Tex.

[73] Assignee: Midland Tank Rental Company, Midland, Tex.

[21] Appl. No.: 815,294

[22] Filed: Jul. 13, 1977

[51] Int. Cl.[2] ..... B65H 17/46

[52] U.S. Cl. ..... 242/86.5 R

[58] Field of Search ..... 242/86.5 R, 86.52, 86.7, 242/76, 158 B, 158.4 B, 86.6, 86.61, 86.62, 86.63, 86.64; 254/175.5, 175.7, 166

[56] References Cited

U.S. PATENT DOCUMENTS

| | | | |
|---|---|---|---|
| 2,767,937 | 10/1956 | Gisonno | 242/158.4 R |
| 3,000,588 | 9/1961 | Brady | 242/86.5 R |
| 3,070,324 | 12/1962 | Bryman | 242/86.5 R |
| 3,103,345 | 9/1963 | Eitel | 242/86.5 R X |
| 3,739,985 | 6/1973 | Odom | 242/86.5 R |
| 3,995,355 | 12/1976 | Sneed | 242/86.5 R |

*Primary Examiner*—Edward J. McCarthy
*Attorney, Agent, or Firm*—Pravel, Wilson & Gambrell

[57] ABSTRACT

Flexible pipe used to supply water to remotely located drilling rigs, typically made from a suitable synthetic resin such as polyethylene, is laid and retrieved from spools or reels mounted with a vehicle as the vehicle is moving. The vehicle may be a truck or a trailer drawn by a truck or tractor. Guiding structure is provided on the vehicle to facilitate loading and unloading of the pipe from the reels.

32 Claims, 7 Drawing Figures

2
2
12
22
30
32
14
R
24
16
20
26
28
38
34
42
52
64
C
40
T
A
76
82
5
P
80
G
72
18
18a
36
5
44

14
12
34
38
52
62
3
56
68
P
W
36
18
66
40
50
C
14
22
42
52
62

4
52
64
62
70
66a
50
60
56
54
68
66b
66
4

60
58
56
50
64
P
52
54
54a 78
74
P
82
82
74
80
72

APPARATUS AND METHOD FOR DISPENSING AND RETRIEVING FLEXIBLE PIPE

BACKGROUND OF THE INVENTION

1. FIELD OF INVENTION

The present invention relates to apparatus and methods of dispensing and retrieving flexible pipe.

2. DESCRIPTION OF PRIOR ART

When wells are being drilled in remote areas fuel and fluid, such as water, for the drilling rig are supplied by temporarily laid flexible pipe. The flexible pipe is usually made from a suitable synthetic resin, such as polyethylene.

Although vehicle mounted reels and winding and control mechanisms for lengths of hose, pipe cable, wire and the like have long been known, these structures were not, so far as is known, readily adapted for use in connection with laying and retrieval of flexible pipe for drilling rigs. Flexible pipes of two miles and longer in length were often required for remote rigs. Additionally, weight became a problem for these lengths of flexible pipe. For example, 2 inch outside diameter polyethylene pipe weighs on the order of sixty pounds for each one hundred feet.

U.S. Pat. No. 3,995,355 discloses that a flexible pipe was laid and retrieved from reels or spools on the bed of a truck. During retrieval, the vehicle was stationary while reeling in the flexible pipe, and the pipe was cut or severed into a number of segments, each segment shorter in length than the contents of a spool. After each segment was pulled onto the spool, the truck was moved to a position near the next pipe segment. However, before the next pipe segment could be reeled onto the spool, attachment by fusion welding to the end of the pipe already on the reel was necessary. Since fifteen or twenty minutes is required to effect a satisfactory fusion weld, this retrieval technique was time consuming.

SUMMARY OF THE INVENTION

Briefly, the present invention provides a new and improved apparatus and method for retrieving flexible pipe which is laid over terrain to connect a well drilling rig with a supply of fuel, such as natural gas, or fluid, such as water. The flexible pipe is also dispensed with new and improved apparatus of the present invention.

In retrieving the pipe, an end of the pipe is attached to a storage reel mounted on a transport vehicle. The vehicle, which may be a truck or a drawn trailer, is then moved over the terrain over which the pipe has been previously laid, and the flexible pipe is drawn onto the storage reel as the vehicle is moving. With the method of the present invention, the retrieval time is significantly reduced because relatively long lengths of flexible pipe can be retrieved without severing the pipe or halting the retrieving operations until the reel is filled. The vehicle moves along the flexible pipe is drawn onto the reel until the reel is full or substantially full. The pipe may be cut into lengths for filling or substantially filling a reel prior to retrieval or left uncut until a storage reel is full. In either instance, a new storage reel, which may be on the vehicle, is then attached to the cut end of the pipe remaining on the terrain and retrieval operations resumed.

With the present invention, structure is provided in the apparatus of the present invention to permit both retrieval and dispensing of the flexible pipe from the vehicle while the vehicle is moving forwardly, reducing the time and complexity of both dispensing and retrieval. Also, level winding control structure is provided forwardly of the storage reel on the vehicle to permit forward movement of the vehicle during retrieval and to control winding of the flexible pipe onto the reel in orderly, closely wound spirals to minimize tangling of the pipe. Further, guiding channel structure is provided at the front of the vehicle to guide the pipe past the forward end of the vehicle to the level winding control structure, to assist in level winding of the pipe onto the storage reel and to prevent the pipe from interfering with the moving vehicle.

It is an object of the present invention to provide a new and improved method and apparatus for retrieval and dispensing of flexible pipe.

DESCRIPTION OF THE PREFERRED EMBODIMENT

Figure 6:
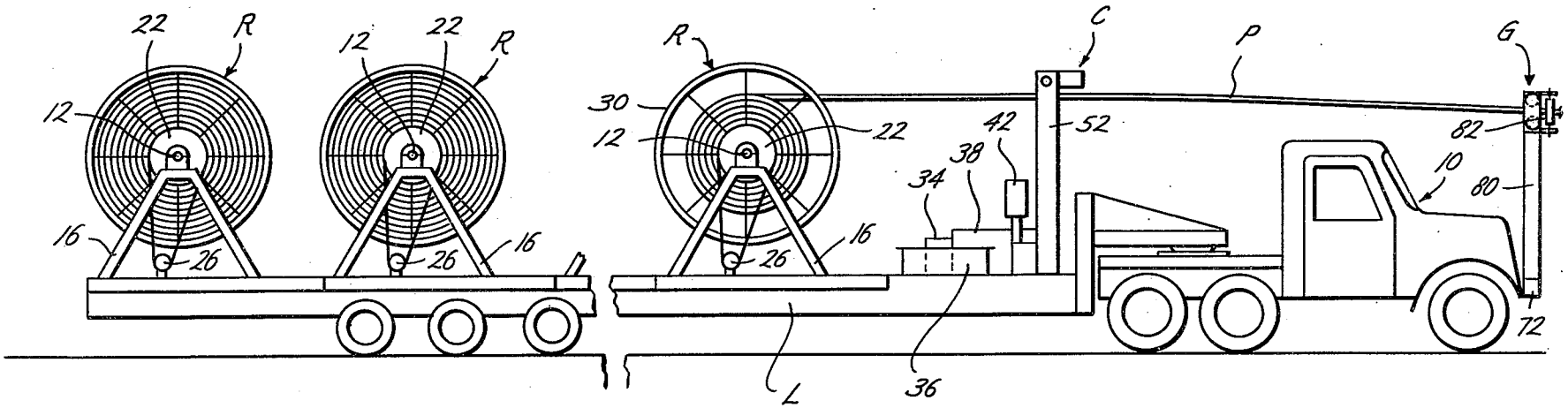
FIG. 6 is an elevation view of a flexible pipe laying drawn trailer according to the present invention.

In the drawings, the letter A designates generally the apparatus of the present invention for dispensing pipe from one or more storage reels or spools R mounted with a vehicle V, which may be a truck T (FIG. 1) or a trailer L (FIG. 6) drawn by a truck or tractor 10. The apparatus A is used to dispense and retrieve flexible pipe P, usually of a suitable synthetic resin, such as polyethylene. The pipe P is used to connect a well drilling rig with a supply of fuel, such as natural gas, or a supply of fluid, such as water. In remote areas, it is not unusual for pipe lengths of one or more miles to be necessary to connect a well drilling rig with a water or fuel supply.

Figure 1:
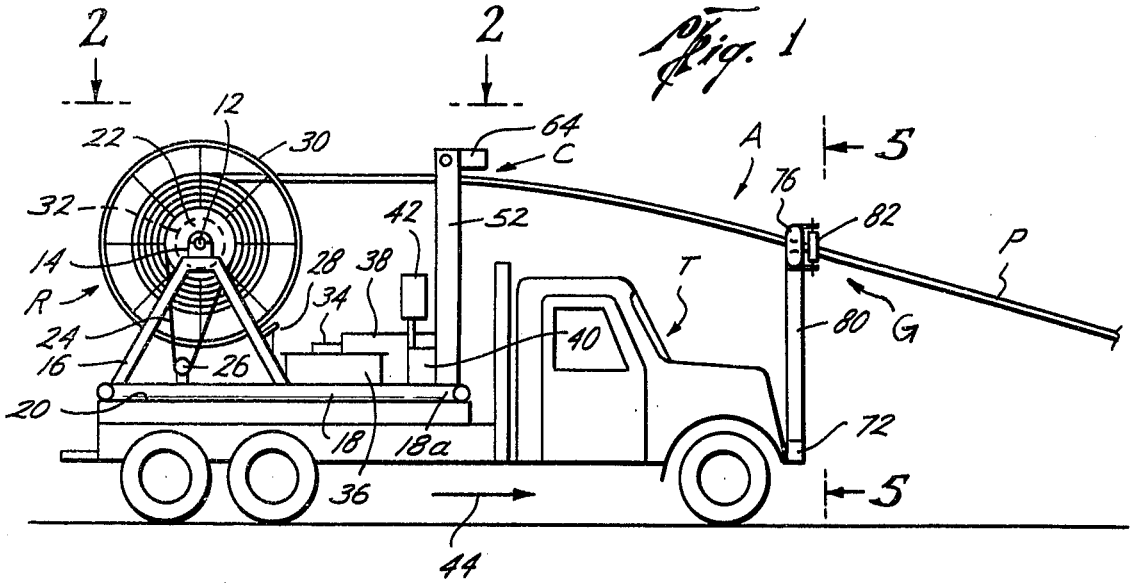
FIG. 1 is an elevation view of a flexible pipe retrieving and dispensing truck according to the present invention.

Considering the apparatus of FIG. 1 more in detail, the storage reel R is mounted to rotate about an axis on a shaft 12 thereof parallel to that of the wheel axles of the vehicle V and transverse to the length of the vehicle V on pillow block bearings or other suitable support structure 14. The bearings 14 are formed into two separable parts so that the reel R may be inserted and removed when desired. The reel R is supported on brackets 16 mounted with a sled 18 which is mounted in a rear bed 20 of the truck T.

The storage reel R includes an upper drive wheel 22 receiving a chain or drive belt 24 thereabout which is driven by a hydraulic motor or other suitable drive means 26 mounted with the sled 18. A brake shoe 28, such as a manually operable one, is mounted on the sled 18 at a position where it may be selectively brought into engagement with an outer rim portion 30 of the reel R to control the rotational speed thereof and thereby control tension exerted on the pipe P during dispensing and retrieval.

The reel R is typically of a radius substantially equal to the distance between the shaft 12 and the sled 18, but is shown in reduced size in order that other structure on the sled 18 may be more clearly seen. The storage reel R includes an inner cylinder 32 having an opening (not shown) therein so that an end of the pipe P may be inserted therein and the pipe P wound thereabout in a spiral manner during retrieval. The reel R is of a sufficient diameter that a substantial length of pipe P may be received and stored thereon. For example, with a storage reel R having an outer rim 30 with a diameter of seven feet, approximately 5,000 feet of two inch outside diameter polyethylene pipe may be received and stored.

The hydraulic motor 26 of the storage reel R is driven by a hydraulic pump 34 through conduits which receives hydraulic fluid from a reservoir 36 by conduit and is driven by a motor 38 to cause the storage reel R to be rotated. The motor 38 receives operating fuel from a storage tank 40. A control valve station 42 controls the direction of fluid flow through the hydraulic motor 26 so that the direction of rotation of the storage reel R can be reversed as necessary during dispensing and retrieval of the pipe P.

Figure 2:
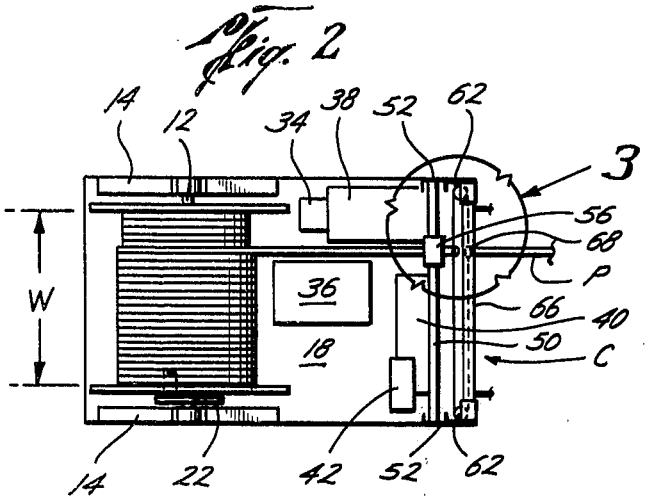
FIG. 2 is a view taken along the lines 2—2 of FIG. 1.
Figure 3:
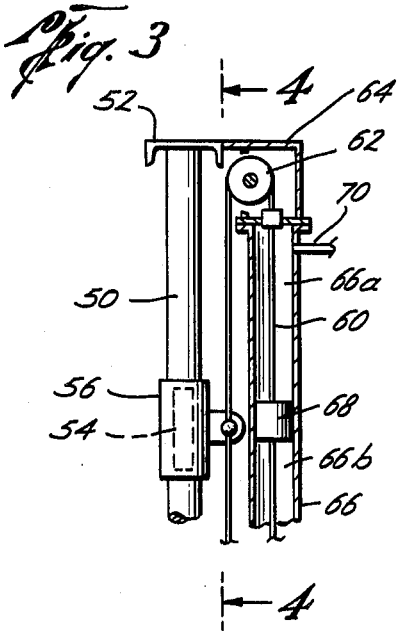
FIG. 3 is an enlarged view of a portion of the structure of FIG. 2 encircled and having the numeral 3 designating same.
Figure 4:
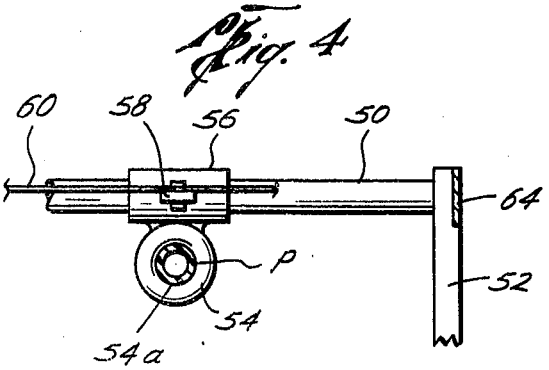
FIG. 4 is a cross-sectional view taken along the lines 4—4 of FIG. 3.

The apparatus A of the present invention further includes a level wind control structure C (FIGS. 1–4 and 6) which guides the flexible pipe P onto the storage reel R during retrieval operations. The level wind control C (FIGS. 1 and 2) is mounted on the vehicle V forward of the storage reel R so that the vehicle may move in the direction the flexible pipe is being retrieved, as indicated by an arrow 44, during retrieval operations. In this manner, the pipe may be retrieved and the truck T moved continuously over the terrain where the pipe was laid until the storage reel R is substantially full with the pipe, effecting a substantial saving in time and labor over the prior art method of dispensing and retrieving flexible pipe.

Considering the level wind control C more in detail (FIGS. 2–4), a support rod bar 50 is mounted at upper ends of vertical support channel members 52 mounted on a forward end 18*a* of the sled 18. A guide sleeve 54 having an opening 54*a* therethrough for passage of the pipe P is mounted beneath the support bar 50 and is movable with respect thereto in response to horizontal travel of a sliding sleeve member 56 along support bar 50. The sleeve member 56 has a lug 58 mounted extending outwardly and forwardly therefrom which is connected to a cord or cable 60 to transmit driving movement to the guide sleeve 54.

The cable 60 is in the form of a horizontal loop which passes around pulleys 62 mounted at opposite ends of the support bar 50 on support members 64 extending forward of the support bar 50.

The entry of fluid alternately into the opposite ends of the cylinder 66 is controlled by valves at valve control station 42 to control reciprocating horizontal travel of the guide sleeve 54 having the pipe P supported therein. Further, the speed of travel of the piston 68 in cylinder 66 and consequently the horizontal travel speed is adjusted by valve control station 42 as needed in accordance with the winding rate of the reel R driven by the motor 26, as further governed by brake 28. In this manner, the feeding of the pipe P onto the reel R into adjacent orderly spirals is obtained. The pipe P is wound about the reel R in one spiral, coiled layer across the width W thereof.

At the end of each such layer of pipe, the piston 68 reaches an end of the cylinder 66. A new layer of pipe is started by winding a first spiral over the previous layer at the end of the reel R, and fluid connections to the piston 66 reversed, reversing the direction of travel of the piston 66, so that the guide sleeve 54 can travel horizontally and again feed the pipe P into orderly spirals on the reel R. A drive cylinder 66 containing a drive piston 68 therein is mounted between support members 64. The piston 66 is substantially equal in length to the width W of the reel R, for reasons to be set forth. The cylinder 66 receives operating fluid from the pump 34 through inlet conduits, one of which is shown as 70 (FIG. 3), at opposite ends thereof. Fluid from pumps 34 is admitted into the cylinder 66 into chamber portions 66*a* and 66*b* on opposite sides of the piston 68 to drive the piston 68 transversely between opposite ends of the cylinder 66.

Figure 5:
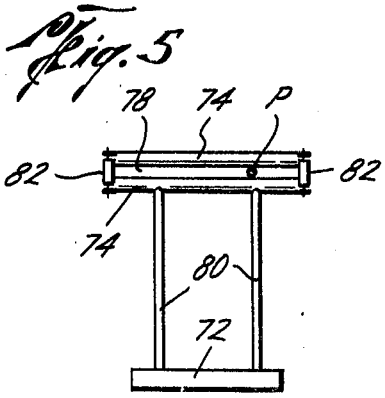
FIG. 5 is a view taken along the lines 5—5 of FIG. 1.

The apparatus A of the present invention further includes a guide channel G (FIGS. 1 and 5) mounted on a forward portion, such as a front bumper 72, of the truck T. The guide channel G includes a pair of horizontally extending pipe or bar members 74 and vertical end members 76 thereby forming a guide slot 78. The guide channel G is mounted extending horizontally above the front bumper 72 of the truck T on upright supports 80. The guide channel G may be removable or the supports 80 may be collapsible or folding in order to insure unobstructed vision of a driver of the truck T during travel over highways. The guiding slot 78 permits passage of the pipe P therethrough to the guide sleeve 54 of the level wind control C.

It is important to note that the guiding slot 78 extends parallel to the axis 12 of the storage reel R and is substantially co-extensive in width to the width W of the reel R. In this manner, as the pipe P is moving past the forward end of the truck T to be wound onto the storage reel S, it may move laterally and transversely across the forward end of the truck T for the width of the storage reel R without interference or entanglement with the truck T. In this manner, the pipe P may easily be fed through the level wind control C, permitting an operator to guide and control the feeding of the pipe onto the reel and assure orderly coiled helical spirals of pipe on the storage reel S.

A pair of guiding rollers 82 are rotatably mounted at opposite ends of the guiding channel G for rotation about their vertical axes. The guiding rollers 82 roll when contacted by the pipe P and protect the pipe P against damage during turning movements of the truck T with respect to the pipe. It is not unusual for the pipe to be laid around corners in field operations and the rollers 82 prevent the pipe from scaping or damage during turning movements of the truck T with respect to the pipe P.

It is important to note that the guide slot 78 extends parallel to and substantially co-extensive with the rotational axis of the storage rel for an additional reason. In remote and inaccessible areas, it is undesirable to lay the pipe P directly on the road over which equipment trucks drive to reach the drilling rig, since the pipe might be damaged by these trucks. The pipe is thus laid in the terrain adjacent to the road over which the equipment trucks pass and it is often very difficult to drive the truck T in a straight line along which pipe is laid over the terrain. However, with the guiding slot 78 extending transversely across the truck T, the truck may drive along the equipment truck road and the pipe may be drawn from the rough terrain onto the storage reel using the level wind control C and the guiding channel G. Due to the width of the guiding channel G being co-extensive with the width of the reel R, the pipe P may move transversely therethrough under the forces exerted thereon by the level wind control C without undue tension or twisting. Further the guiding rollers 82 permit the pipe to pass through the guide channel G with relative case and reduced possibility of damage.

Considering now the apparatus A using the trailer L (FIG. 6), like structure to that of the truck T in FIG. 1 bears like reference numerals. With the trailer L, a plurality of storage reels R are mounted in a row on the trailer L on rotational axes 12 transverse to the length of the trailer L. The number of reels R may be any suitable number depending on the size and load capacity of the trailer L. Each of the storage reels R has associated therewith a drive motor 26, each drive motor driving a separate and individual one of the plural storage reels R. The drive motors 26 are selectively energized by individual control valves in the control valve station 42.

The trailer implementation of the present invention includes level wind control structure C of the type set forth above which is mounted towards a forward end of the trailer L. Further, the apparatus A using the trailer L includes a guide channel means G of the type set forth above with respect to the truck T.

Figure 7:
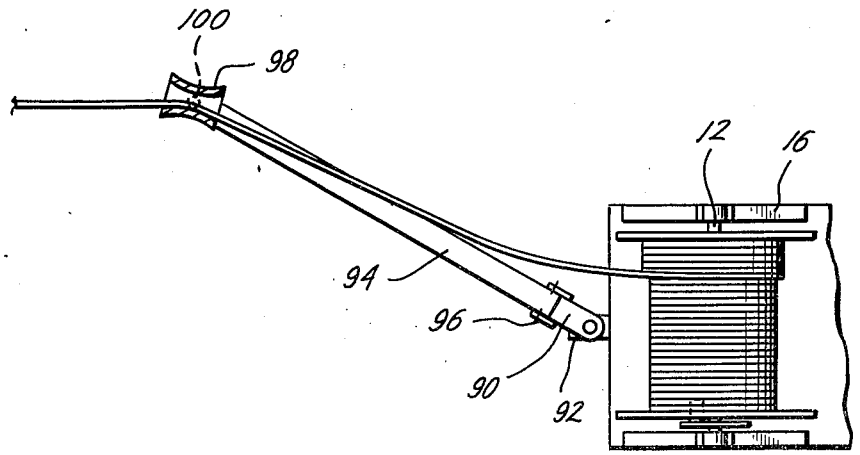
FIG. 7 is a plan view, taken partly in cross-section, of a pipe layout boom for dispensing pipe from the truck of FIG. 1 or trailer of FIG. 6.

If desired, a layout boom B (FIG. 7) may be mounted at either the front or rear end of either the trailer L or the truck T to aid in dispensing or retrieving the pipe P. The layout boom B includes an inner support arm 90 pivotally mounted at a connection 92 with respect to a lug extending rearwardly from the vehicle with which such boom is being used. The pivot arm 90 permits pivotal movement of the layout boom B in the horizontal plane to a desired position for guiding the pipe P onto the terrain during dispensing, or onto the reel R during retrieval. An extension arm 94 is pivotally mounted to the arm 90 at a connection 96 so that the layout boom B may be raised or lowered in vertical planes to a desired position during dispensing or retrieval of pipe from the storage reels R. A hollow guide snout 98 is pivotally mounted by a ball joint 100 at an outer end of the extension arm 94 and guides and supports the pipe past the layout boom B as such pipe is being dispensed or retrieved.

DISPENSING OPERATIONS

In dispensing according to the present invention, a connection of the pipe P on the rearmost storage reel R by fusion welding or otherwise is made at a first end or terminus, either the drilling rig or the source of fuel or fluid. The type of vehicle used, whether a truck or drawn trailer is typically based on the type of terrain over which the pipe P is to be laid and the amount of such pipe to be laid. Where the terrain is specially rugged or difficult, the truck T is preferable for reasons of ease in handling.

The vehicle is then driven forward over the terrain toward the other terminus. The rotational speed of the reel R is controlled by regulating the speed of motor 26 and selective application of the brake 28 in order to exert tension on the pipe P. Control of tension on the pipe P is exerted in this manner to control the position and amount of pipe laid. The laybout boom B may be used, if desired, for more precise control of the position on the terrain where the pipe P is laid.

The vehicle is driven over the terrain towards a second era or terminus until the pipe on the reel R is laid or until the other terminus is reached. When the pipe on the rearmost reel R has been laid, a connection is made between the pipe already laid and the contents of the next rearmost storage reel R. Dispensing operations continue in this manner until the other end or terminus of the pipe is reached. At this time, the laid pipe is severed from that remaining on the storage reel R and connected to the second end.

RETRIEVAL OPERATIONS

When the laid pipe is to be retrieved or recovered, an end is severed and attached to the rearmost empty storage reel R. If desired, the laid pipe may be previously severed into lengths substantially filling an entire storage reel in order to permit fluid drainage. The vehicle is then driven along the course over the terrain where the pipe P has been laid.

The speed of rotation is controlled as the vehicle is being driven so that the pipe is subjected to a tension force, drawing the pipe onto the reel. As the vehicle moves over the terrain, the guide sleeve 54 of the level wind control C traverses horizontally along the support bar 50 so that the pipe P is wound onto the storage reel in orderly, closely wound spiral layers. The guide channel structure G further permits the pipe P to pass to the level wind control C without interfering with forward movement of the vehicle. After each layer is wound onto the reel R, fluid connections to the cylinder are severed and the piston caused to move in the opposite direction, causing a new spiral layer of the pipe P to be wound onto the reel R.

With the level wind control C and guide channel G mounted on the vehicle V forward of the storage reel R, the vehicle R may move continuously forward over the terrain in retrieving pipe. In this manner, the pipe P is drawn onto the storage reel R until the storage reel R is substantially entirely full therewith.

At this time, the pipe remaining on the terrain is severed from that remaining on the ground, and the severed end of the remaining pipe connected to the next most forward storage reel R, the vehicle R begins to again move forward and retrieval operations resumed. When the vehicle has only one storage reel R, the full reel is then unloaded and replaced with a new reel. Retrieval in the foregoing manner continues until the entire length of the pipe P has been retrieved.

The foregoing description and disclosure of the present invention is illustrative and explanatory thereof and various changes in the size, shape and material, as well as in the illustrated construction of the preferred embodiment may be made without departing from the spirit of the invention.

We claim:

1. A method of laying and retrieving flexible pipe which is laid over terrain to connect a well drilling rig with a supply of fuel or fluid for the rig, comprising the steps of:

(a) initially laying the pipe out from the vehicle to connect the well to the supply of fuel or fluid;

(b) moving the vehicle forward during said step of initially laying;

(c) removing the pipe rearwardly from the forwardly moving vehicle;

(d) retrieving the pipe by attaching an end of the pipe to a storage reel mounted on a vehicle;

(e) moving the vehicle forwardly along the terrain over which the pipe is laid; and (f) drawing pipe onto the reel as the vehicle is moving.

2. The method of claim 1, wherein:

said steps of moving and drawing are performed until the storage reel is substantially full with the flexible pipe.

3. The method of claim 2, furher including the steps of:

(a) separating the pipe on the storage reel from that remaining on the terrain;

(b) attaching the end of the flexible pipe remaining on the terrain to a new reel;

(c) resuming said step of moving; and (d) drawing the pipe onto the new reel during said step of moving.

4. The method of claim 2, further including the step of:

removing the full reel from the vehicle.

5. The method of claim 2, further including the step of:

replacing the full reel with an empty storage reel.

6. The method of claim 1, wherein the vehicle is substantially continuously moving during said step of drawing the pipe onto the reel.

7. The method of claim 1, wherein the vehicle is moving forward during said step of moving and wherein:

said step of drawing comprises drawing the pipe past the forward portion of the vehicle onto the reel.

8. The method of claim 1, wherein the storage reel is mounted on the bed of a truck.

9. The method of claim 1, wherein the storage reel is mounted on the bed of a trailer.

10. The method of claim 1, further including the step of:

guiding the pipe into closely wound coils during said step of drawing the pipe onto the reel.

11. The method of claim 1, further including the step of:

severing the pipe at least once at a length sufficient to substantially fill a storage reel prior to said step of attaching.

12. The method of claim 1, wherein plural storage reels are mounted extending rearwardly in a row on the vehicle and wherein:

said step of drawing comprises drawing the pipe onto the plural storage reels beginning with the rearmost of the plural storage reels and continuing sequentially forward thereafter.

13. An apparatus for dispensing and retrieving flexible pipe which is laid over terrain to connect a remote drilling rig with a supply of fuel or fluid for the rig, comprising:

(a) storage reel means for containing the flexible pipe;

(b) vehicle means for transporting said storage reel means over the terrain;

(c) motor means for rotating said storage reel means to dispense and retrieve the flexible pipe;

(d) level wind control means for guiding the flexible pipe onto said storage reel means during retrieval operations;

(e) said storage reel means, motor means and level wind control means being mounted with said vehicle means; and (f) said level wind control means being mounted on said vehicle means forward of said storage reel means wherein said vehicle means may move in the direction the flexible pipe is being retrieved during retrieval operations.

14. The apparatus of claim 13, further including:

(a) guiding channel means mounted on a forward portion of said vehicle means, said guiding channel means having a guiding slot formed therein for passage of the pipe therethrough to said storage reel means; and (b) said guiding slot in said guiding channel means extending parallel to and substantially co-extensve with the rotational axis of said storage reel means to guide the pipe past the forward portion of the vehicle and to facilitate orderly spiral winding of the pipe onto said storage reel means.

15. The apparatus of claim 13, wherein said storage reel means comprises:

a plurality of storage reels rotatably mounted with said vehicle means.

16. The apparatus of claim 15, wherein said plurality of storage reels are mounted in a row on said vehicle means on rotational axes transverse to the length of said vehicle means.

17. The apparatus of claim 15, wherein said motor means comprises:

a plurality of drive motors, each of said plurality of drive motors driving one of said plurality of storage reels.

18. The apparatus of claim 13, wherein said vehicle means comprises a truck having said storage reel means, motor means and level wind control means mounted in a bed thereof.

19. The apparatus of claim 13, wherein said vehicle means comprises a vehicle drawn trailer having said storage reel means, motor means and level wind control means mounted in a bed thereof.

20. The structure of claim 13, further including:

layout boom means mounted with said vehicle means at a rear portion thereof wherein said vehicle means may move forward over the terrain during both dispensing and retrieval of the pipe.

21. The structure of claim 13, wherein said level wind control means comprises:

(a) a support bar extending across the width of said storage reel means;

(b) a guide sleeve movably mounted with said support bar for receiving the pipe and guiding same onto said storage reel means; and (c) means for moving said guide sleeve in a reciprocating path along said support bar to control the winding of the pipe onto said storage reel means.

22. The structure of claim 13, wherein said storage reel means is removably mounted with said vehicle means.

23. An apparatus for dispensing and retrieving flexible pipe which is laid over terrain to connect a remote drilling rig with a supply of fuel or fluid for the rig, comprising:

(a) storage reel means for containing the flexible pipe;

(b) vehicle means for transporting said storage reel means over the terrain;

(c) motor means for rotating said storage reel means to dispense and retrieve the flexible pipe;

(d) said storage reel means being mounted with said vehicle means;

(e) guiding channel means mounted on a forward portion of said vehicle means, said guiding channel means having a guiding slot formed therein for passage of the pipe therethrough to said storage reel means; and (f) said guiding slot in said guiding channel means extending parallel to and substantially co-extensive with the rotational axis of said storage reel means to guide the pipe past the forward portion of the vehicle and to facilitate orderly spiral winding of the pipe onto said storage reel means.

24. The apparatus of claim 23, further including:

guiding roller means mounted with said guiding channel means at opposite ends of said guiding slot to protect the pipe against damage during turning movements of said vehicle means with respect to the pipe.

25. The apparatus of claim 23, further including:

(a) level wind control means for guiding the flexible pipe onto said storage reel means during retrieval operations; and (b) said level wind control means being mounted on said vehicle means intermediate said guiding channel means and said storage reel means to control the winding of the flexible pipe onto said storage reel means.

26. The apparatus of claim 23, wherein said vehicle means comprises a truck having said storage reel means, motor means and level wind control means mounted in a bed thereof.

27. The apparatus of claim 23, wherein said vehicle means comprises a vehicle drawn trailer having said storage reel means, motor means and level wind control means mounted in a bed thereof.

28. The structure of claim 23, further including:

layout boom means mounted with said vehicle means at a rear portion thereof wherein said vehicle means may move forward over the terrain during both dispensing and retrieval of the pipe.

29. The structure of claim 23, wherein said storage reel means is removably mounted with said vehicle means.

30. The apparatus of claim 23, wherein said storage reel means comprises:

a plurality of storage reels rotatably mounted with said vehicle means.

31. The apparatus of claim 30, wherein said plurality of storage reels are mounted in a row on said vehicle means on rotational axes transverse to the length of said vehicle means.

32. The apparatus of claim 30 wherein said motor means comprises:

a plurality of drive motors, each of said plurality of drive motors driving one of said plurality of storage reels.

* * * * *